United States Patent [19]

Chauvier et al.

[11] Patent Number: 4,766,931

[45] Date of Patent: Aug. 30, 1988

[54] SUBMERGED VALVE

[76] Inventors: Daniel J. V. D. Chauvier; Peter Woodman, both of 57 Miller Road, Nuffield Springs, South Africa

[21] Appl. No.: 30,048

[22] Filed: Mar. 26, 1987

[30] Foreign Application Priority Data

Apr. 2, 1986 [ZA] South Africa ..... 86/2408
Sep. 17, 1986 [ZA] South Africa ..... 86/7062

[51] Int. Cl.[4] ..... F16K 31/365

[52] U.S. Cl. ..... 137/624.14; 137/491; 137/907

[58] Field of Search ..... 137/624.14, 907, 491; 251/33

[56] References Cited

U.S. PATENT DOCUMENTS

| | | | |
|---|---|---|---|
| 220,559 | 10/1979 | Wilson . | |
| 2,360,873 | 10/1944 | Grove . | |
| 2,650,607 | 9/1953 | Bryant . | |
| 2,684,075 | 7/1954 | Stossel . | |
| 2,735,642 | 2/1956 | Norman . | |
| 2,771,265 | 11/1956 | Woods | 251/33 X |
| 2,807,141 | 9/1957 | Strader | 137/624.14 X |
| 2,982,511 | 5/1961 | Connor . | |
| 3,007,416 | 11/1961 | Childs . | |
| 3,211,179 | 10/1965 | Lilly | 137/624.14 |
| 3,469,582 | 9/1969 | Jackson . | |
| 3,624,804 | 11/1971 | Gannon . | |
| 3,643,912 | 2/1972 | Livingston . | |
| 3,669,142 | 6/1972 | Gerbic . | |
| 3,759,289 | 9/1973 | DeWall . | |
| 3,883,074 | 5/1975 | Lambert . | |
| 4,070,001 | 11/1978 | Musgrove | 137/907 X |
| 4,195,810 | 4/1980 | Lavin . | |
| 4,313,455 | 2/1982 | Pitman | 137/624.14 X |
| 4,512,514 | 4/1985 | Elcott . | |
| 4,592,379 | 6/1986 | Goette | 137/624.14 X |
| 4,642,833 | 2/1987 | Stoltz | 137/624.14 X |

*Primary Examiner*—Alan Cohan

[57] ABSTRACT

A valve for periodically opening and closing a flow path 11 leading to a suction source for predetermined periods is disclosed. The valve comprises a body 12 defining a first flow passage 13 and a further flow passage 23 therethrough. In body 12 there is mounted a fluid pressure operable closure member 16 for periodically opening and closing flow passage 13. Actuating means driven by water wheel 17 and which includes a variable volume chamber 21, a stopper 19 for an equalization port 20 in chamber 21 and a gear train 18 is adapted periodically to vary the pressure in chamber 21 acting on closure member 16 in response to fluid flow past water wheel 17.

5 Claims, 2 Drawing Sheets

SUBMERGED VALVE

This invention relates to submersible swimming pool cleaners of the kind adapted to be connected to a suction source and to move about in the pool under the influence of kinetic energy imparted to the cleaner due to an intermittend variation in water flow through the cleaner. The invention more specifically relates to a valve for periodically closing off the flow path defined between the cleaner inlet and the suction source.

Automatic swimming pool cleaners of the kind in question may suffer from the disadvantage that they may become stuck behind or against an obstacle in the pool or, that their movement in the pool may become limited to a particular area therein.

It accordingly may become necessary to move the cleaner away from such obstacle or area. Means for achieving this goal is disclosed in the applicant's copending U.S. patent application Ser. No. 030,132 entitled "Displacement apparatus for submerged cleaners".

A disadvantage of a cleaner including the abovementioned displacement apparatus is the fact that the effectiveness of the displacement apparatus is reduced by the suction of the cleaner against the pool floor or wall to be cleaned.

It accordingly is an object of the present invention to provide valve means to be used with the cleaner and displacement apparatus and which it is believed will at least alleviate the above disadvantage.

According to the invention a valve for periodically opening and closing a flow path leading to a suction source for predetermined periods comprises

- a body having a first flow passage extending between an inlet to the body and an outlet from the body;
- the inlet and the outlet being connectable into the flow path;
- a closure member for the flow passage movable between a position wherein the flow passage is open and a position wherein the flow passage is closed;
- actuating means adapted periodically to operate the closure member; and
- fluid driven means adapted to drive the actuating means thereby to cause the closure member periodically to move between its open and closed positions thereby to open and close the flow passage for predetermined periods in response to and proportional to fluid flow past the fluid driven means.

The predetermined periods may be proportional to predetermined volumes of fluid having passed the fluid driven means.

The closure member may be a fluid pressure operable closure member and the actuating means may be adapted periodically to vary fluid pressure acting on the closure member to operate such member.

Preferably a further flow passage is also defined in the body to extend from a further inlet to the body and to converge into the first flow passage downstream from the closure member. The fluid driven means may be mounted in this further flow passage.

The actuating means may comprise a variable volume chamber communicating with suction pressure downstream of the closure member and with ambient pressure via an equalization port; and a closure member for the port periodically operable to open and close the port thereby periodically to vary the pressure in the chamber.

In one embodiment of the valve according to the invention the flow passage closure member is a transversely contractable and expansible tubular member the bore of which defines at least part of the flow passage, and the variable volume chamber is located immediately externally of the tubular member, the chamber communicating with suction pressure externally of the tubular member.

In another embodiment of the valve according to the invention the variable volume chamber is defined within a longitudinally contractable and expansible bellows member; the bellows member being connected at its one end to a flow passage closure member for periodically moving the latter between its open and closed positions.

The flow passage closure member may be a rigid member connected to the end of the bellows member by a tubular stem communicating at its one end with the chamber within the bellows member and at its other end with suction pressure through a bore defined through the closure member.

The timing means comprises a gear train; the gear tain at its input end being connected to the fluid driven means and at its output to a cam, the cam being operable to cause the equalization port closure member, which is biassed towards a position wherein it is in sealing engagement with the equalization port, to move between that position and a position away from said port.

The cam may be programmable so that the periods during which the equalization port is open and closed may be adjusted to suit practical requirements.

This invention also extends to a submersible suction cleaner comprising a valve as hereinbefore described. The body of the valve may in some applications be constituted by the head or body of the cleaner defining the flow passage therethrough.

The invention will now further be described by way of example only with reference to the accompanying drawings in which.

Figure 1:
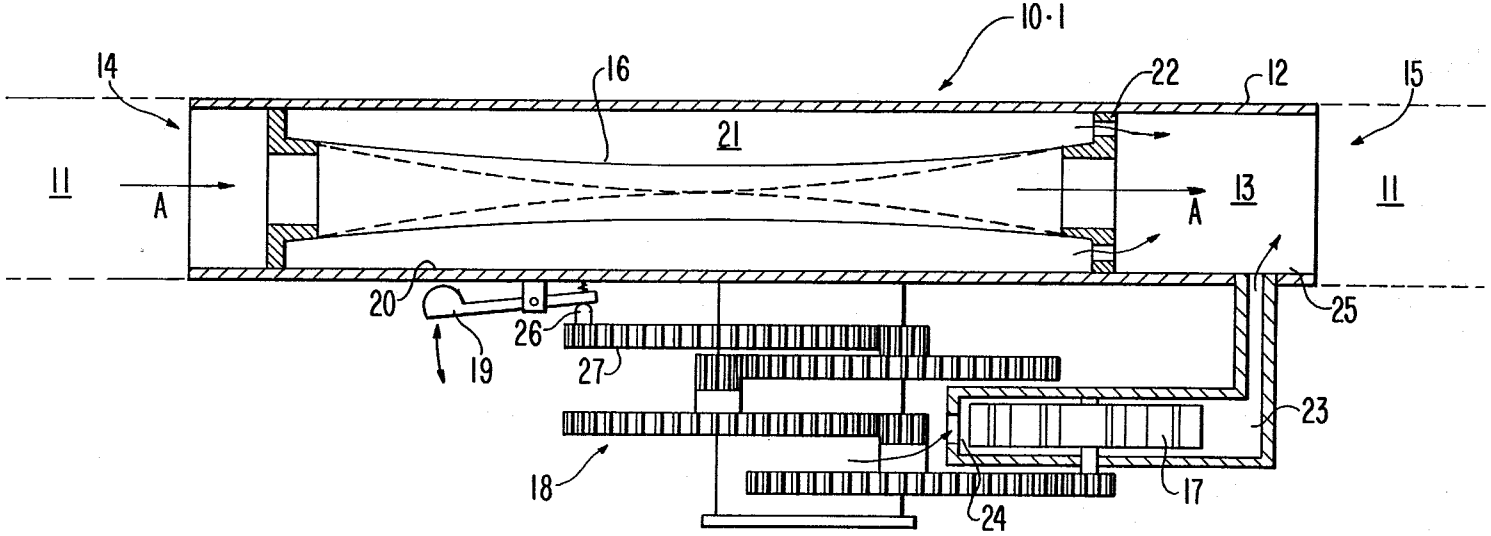
FIG. 1 shows a diagrammatic axial cross-sectional view of a first embodiment of the valve according to the invention.
Figure 2:
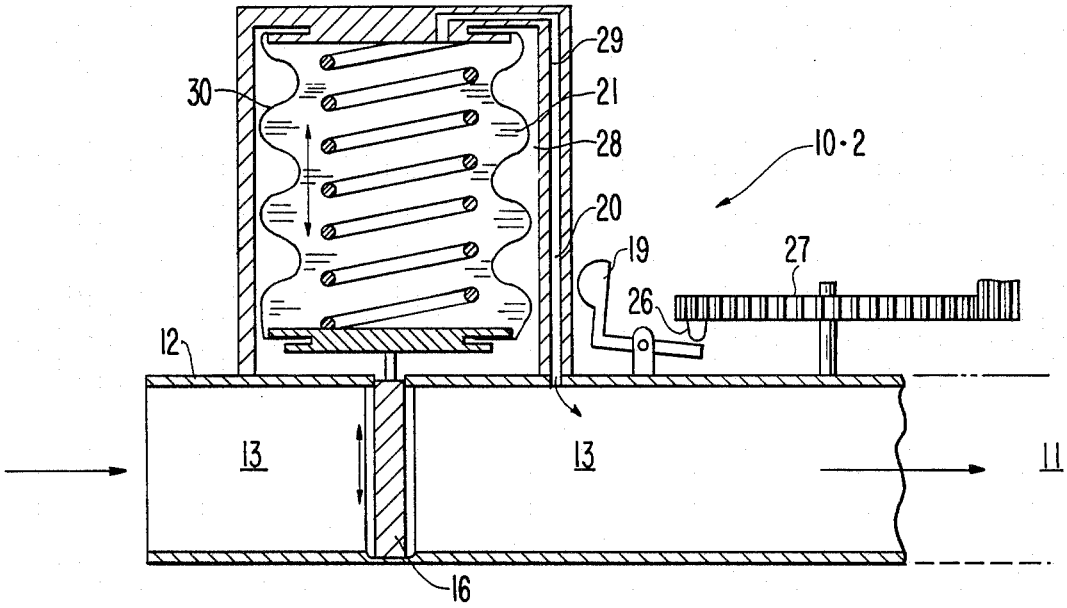
FIG. 2 shows a diagrammatic axial cross-sectional view of a second embodiment of the valve according to the invention.
Figure 3:
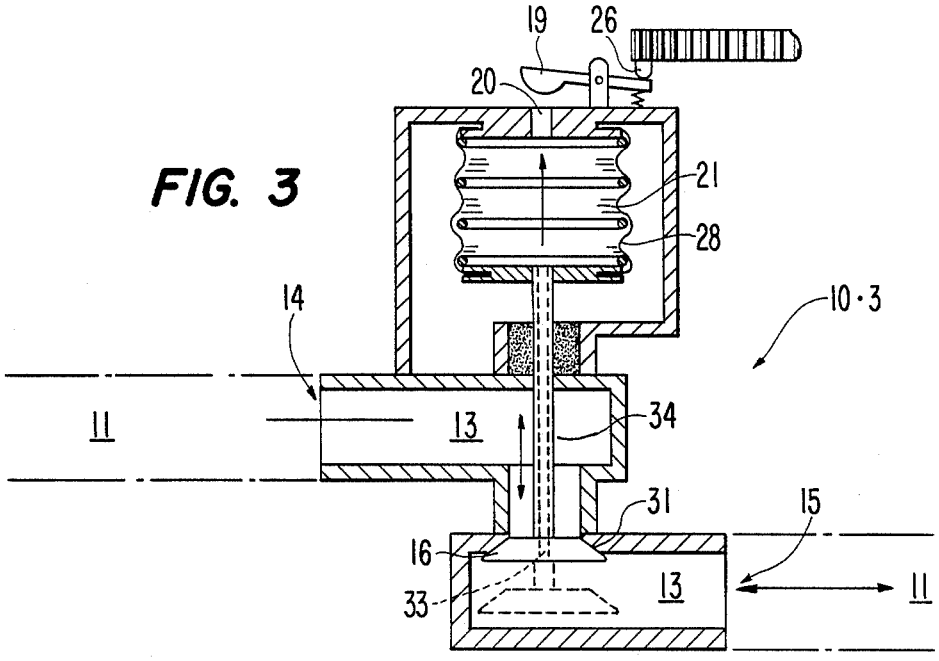
FIG. 3 shows a similar view of a third embodiment of the valve according to the invention.

A valve for periodically opening and closing off a flow path 11 leading to a suction source (not shown) for predetermined periods is generally designated by the reference numerals 10.1, 10.2, 10.3 in FIGS. 1, 2 and 3, respectively. Flow path 11 may extend between an inlet thereto defined in a submersible suction cleaner's head (also not shown) and an outlet therefrom, which is connectable to the suction source.

Each of the above valves , which is adapted to be connectable into flow path 11, comprises a body 12 defining a first flow passage 13 between an inlet 14 thereto and an outlet 15 therefrom, a fluid pressure operable closure member 16 in body 12, actuating means adapted periodically to vary pressure acting on closure member 16 and fluid driven means in the form of water wheel 17 to drive the actuating means.

The actuating means comprises a variable volume chamber 21, a closure member or stopper 19 for an equalization port 20 for chamber 21 and the timing means comprises a gear train 18. As is shown in FIG. 1, gear train 18 at its input is connected to water wheel 17 and at its output to stopper member 19.

Referring now to the three embodiments individually, and first to that shown in FIG. 1, the flow passage closure member 16 comprises a transversely contractable and expansible elastomeric tubular member, the bore of which defines at least part of flow passage 13. Variable volume chamber 21 is defined about and immediately externally of the tubular member. Chamber 21 which communicates with flow passage 13 at a position downstream from the closure member 12, through ports 22, also has an equalization port 20 therein. A spring biased, lever operable stopper 19 serves to open and close port 20 under the influence of water flow past water wheel 17. The stopper 19 is biased normally to be seated on port 20.

Water wheel 17 is rotatably mounted in a further flow passage 23 extending between an inlet 24 thereto and an outlet 25 therefrom which outlet communicates with flow passage 13 at a point downstream from the closure member 16. Gear train 18 is employed to link water wheel 17 and a cam comprising projection 26 disposed on gear wheel 27.

As projection 26 is moved into and out of engagement with the lever of stopper 19 by water wheel driven gear train 18, the pressure in chamber 21 which acts on closure member 16 is periodically varied to cause the latter periodically to move between its open and closed positions.

In use, with vale 10.1 open and due to the applied suction water will flow from the inlet in the cleaner head to the suction source along flow path 11 in the direction indicated by the arrows A. Water will also flow through further flow passage 23 and past water wheel 17 towards the suction source. When projection 26 is not in contact with the lever of stopper 19, that is, with the stopper in its normally closed position, the pressure in chamber 21 will be substantially equal to the pressure in the bore of tubular member 16. Flow path 13 hence will be open so that water will be able to flow through the cleaner towards the suction source. The cleaner will hence be fully operational and able to move about in the pool (not shown) under the influence of its own driving mechanism. However, when projection 26 causes stopper 19 to move away from port 20, the pressure in chamber 21 will increase causing tubular member 16 to contract thereby to close-off flow passage 13 and consequently flow path 11. No or substantially no water will acccordingly be able to flow through the cleaner towards the suction source so that the cleaner will be deactivated during this period.

It will be appreciated that the periods for which the port 20 will be open and closed is dependent on various factors such as the rate of water flow past water wheel 17, the gear ratio of gear train 18 and the length of projection 26.

With the cleaner in this deactivated condition a propeller driven displacement apparatus (not shown), such as that disclosed in the aforementioned U.S. patent application, may be activated in order to displace the cleaner from one position in the pool to another or away from an obstacle which it may have encountered in the pool.

When projection 26 has moved away from the lever, stopper 19 will again close port 20. Tubular member 16, due to substantially equal pressures internally and externally thereto and under the influence of its own resilience, will expand so that water flow will again commence through flow passage 11. The cleaner will hence again become operational and able to move about in the pool under the influence of its own driving mechanism.

Referring now to the second embodiment which is shown in FIG. 2, closure member 16 is a rigid disc-like member adapted to be movable in suitable slots (not shown) defined in the walls of body member 12 defining flow passage 13. Varible volume chamber 21 is defined within a bellows member 28. The chamber 21 communicates with flow passage 13 and hence with the flow path 11 at a point downstream from the closure member via conduit 29. The equalization port 20 for variable volume chamber 21 is provided in conduit 29 and spring biased, lever operable stopper 19 serves to open and close port 20 under the influence of water flow past a water wheel which is not shown in the figure, but which may be similar to and similarly mounted as that described in respect of the embodiment in FIG. 1. Stopper 19 is biased normally to be seated on port 20. A spring 30 is provided within bellows member 28 and serves to bias closure member 16 towards its closed position as shown in FIG. 2.

In use, when suction is applied at the downstream end of flow path 11, and with port 20 closed, chamber 21 is evacuated so that closure member 16 is held in its open position by a longitudinally contracted bellows member 28. Water will accordingly flow through the cleaner head towards the suction source so that the cleaner will be fully operative.

However, when projection 26 is brought into contact with the lever of stopper 19, the latter will be displaced from port 20. The pressure in chamber 21 will accordingly rise so that spring 30 will overcome the contracting force of the bellows causing bellows member 28 longitudinally to expand and to cause closure member 16 to move downwards into its closed position, thereby to close-off flow passage 13 and hence also flow path 11. No or substantially no water will now be able to flow through the cleaner towards the suction source so that the cleaner will be deactivated during this period.

When projection 26 has moved away from the lever, stopper 19 will again seat on port 20 with the result that chamber 21 will again be evacuated due to the downstream applied suction. Closure member 16 will hence be moved from its closed position to it open position thereby enabling water to flow through the cleaner towards the suction source resulting in the cleaner being operative again.

Referring now to the embodiment show in in FIG. 3, the flow passage closure member comprises a rigid member 16 adapted to be movable between a closed position wherein it is in sealing engagement with seat 31 and a open position away therefrom. Variable volume chamber 21 is defined within bellows member 28 and spring biased lever operable stopper member 19 serves to open and close equalization port 20 under the influence of water flow past a water wheel not shown in the figure, but which may be similar to and similarly mounted as that described in respect of the embodiment in FIG. 1. Stopper member 19 is biased normally to be seated on port 20.

Flow passage closure member 16 is rigidly connected to one end of bellows member 28 by a hollow tubular stem 32. Chamber 21 therefore communicates with suction pressure downstream of closure member 16 through the bore in stem 32 and through a bore 33 defined in closure member 16.

In use, when suction is applied at the downstream end of flow path 11, and with port 20 closed, chamber 21 is evacuated so that closure member 16 is held in its closed position by a longitudinally contracted bellows member 28. No water will accordingly be able to flow through flow path 11 so that the cleaner will be deactivated during this period.

However when projection 26 moves into engagement with the lever of stopper 19, the latter will be displaced from port 20. The pressure in chamber 21 will rise causing bellows member 28 longitudinally to expand and closure member 16 to be moved away from seat 31. Water will accordingly now be able to flow through the cleaner head towards the suction source so that the cleaner will again be fully operational.

It will be appreciated that many variations of the value according to the invention may be made by those skilled in the art without departing from the scope and spirit of the present invention.

We claim:

1. A valve adapted to periodically interrupt suction along a submerged suction conduit through which liquid flows toward a suction source, said valve comprising:

a body defining a first flow passage therethrough extending between an inlet to and an outlet from the body;

said body being operatively connected with said submerged suction conduit, with said outlet being connected with said suction source;

a closure member movably mounted within said body for movement between a closed position which blocks flow through said flow passage and an open position which permits flow through said flow passage;

timing means for controlling the length of time said closure member remains in it open and closed positions; and actuating means to cause said closure member to move to its open and closed positions at predetermined intervals as determined by said timing means;

said timing means comprising a gear train;

said actuating means comprising:

a variable volume chamber;

an equalisation port defined in said chamber; and a movable port closure member;

said movable port closure member being movable between a position which opens said port and a position which closes said port;

said movable port closure member being operatively engageable with said gear train;

whereby said gear train determines when said port closure member opens and closes said port;

a further flow passage having an inlet thereto and an outlet into said body downstream of said closure member in the body;

a water wheel rotatably mounted in said further flow passage and connected with said gear train;

said liquid flow toward said suction source causing some of said liquid to enter said further flow passage through said inlet and to rotate said water wheel as it passes to said outlet;

said port closure member normally being in a position which closes said port and said operation of said gear train periodically causing said port closure member to open and close said port thereby causing said closure member in the body periodically to move between its open and closed positions.

2. A valve as claimed in claim 1 wherein the gear train comprises a programmable cam for operating the port closure member.

3. A valve as claimed in claim 1 wherein the closure member in the body is a transversely contractable and expansible tubular member having an internal bore of which defines at least part of the first flow passage, wherein the varible volume chamber is located immediately externally of the tubular member and wherein the chamber communicates with suction pressure externally of the tubular member.

4. A valve as claimed in claim 1 wherein the variable volume chamber is defined within a longitudinally contractable and expansible bellows member; the bellows member at one end being connected to the closure member in the body for periodically moving the latter between its open and closed positions.

5. A valve as claimed in claim 4 wherein the closure member in the body is a rigid member connected to the one end of the bellow members by a tubular stem communicating at its one end with the chamber within the bellows member and at its other end with suction pressure through a bore defined through the closure member in the body.

* * * * *